US008770321B2

(12) United States Patent
Makkar et al.

(10) Patent No.: US 8,770,321 B2
(45) **Date of Patent: *Jul. 8, 2014**

(54) DOWNHOLE REAMER ASYMMETRIC CUTTING STRUCTURES

(71) Applicant: Smith International, Inc., Houston, TX (US)

(72) Inventors: Navish Makkar, Houston, TX (US); Tommy G. Ray, Houston, TX (US); Manoj Mahajan, Houston, TX (US); Dwayne P. Terracina, Spring, TX (US); Sameer Bhoite, Conroe, TX (US)

(73) Assignee: Smith International, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/047,656

(22) Filed: Oct. 7, 2013

(65) Prior Publication Data

US 2014/0034397 A1 Feb. 6, 2014

Related U.S. Application Data

(63) Continuation of application No. 12/893,652, filed on Sep. 29, 2010, now Pat. No. 8,550,188.

(51) Int. Cl.
*E21B 10/00* (2006.01)

(52) U.S. Cl.
USPC ..... 175/265; 175/267

(58) Field of Classification Search
USPC ..... 175/57, 265, 267
See application file for complete search history.

(56) References Cited

U.S. PATENT DOCUMENTS

| | | | | |
|---|---|---|---|---|
| 8,205,687 | B2 * | 6/2012 | Radford | 175/57 |
| 8,297,381 | B2 * | 10/2012 | Radford et al. | 175/406 |
| 8,550,188 | B2 * | 10/2013 | Makkar et al. | 175/265 |
| 2001/0004946 | A1 | 6/2001 | Jensen | |
| 2003/0029644 | A1 | 2/2003 | Hoffmaster et al. | |
| 2005/0273302 | A1 | 12/2005 | Huang et al. | |
| 2008/0035380 | A1 | 2/2008 | Hall et al. | |
| 2008/0105464 | A1 | 5/2008 | Radford | |
| 2009/0266614 | A1 | 10/2009 | Meister | |
| 2010/0018779 | A1 | 1/2010 | Makkar et al. | |
| 2010/0155149 | A1 | 6/2010 | Keshavan et al. | |
| 2011/0240376 | A1 | 10/2011 | Chen | |

OTHER PUBLICATIONS

International Search Report issued in corresponding International Application No. PCT/US2011/053926; Dated May 24, 2012 (4 pages).

Written Opinion issued in corresponding International Application No. PCT/US2011/053926; Dated May 24, 2012 (5 pages).

* cited by examiner

*Primary Examiner* — William P Neuder
(74) *Attorney, Agent, or Firm* — Osha Liang LLP

(57) ABSTRACT

A cutting structure for use with a reamer in enlarging a borehole in a subterranean formation includes a plurality of cutter blocks, radially extendable from a reamer body away from a central axis of the reamer body, each of the plurality of cutter blocks comprising at least one cutter blade thereon, wherein an angular spacing about the central axis of the reamer body between the at least one cutter blade on each of the plurality of cutter blocks is unequal.

26 Claims, 12 Drawing Sheets

DOWNHOLE REAMER ASYMMETRIC CUTTING STRUCTURES

CROSS-REFERENCE TO RELATED APPLICATIONS

This Application is a Continuation of application Ser. No. 12/893,652 filed on Sep. 29, 2010, which issued as U.S. Pat. No. 8,550,188 on Oct. 8, 2013. That application is incorporated by reference in its entirety.

BACKGROUND

1. Field of the Disclosure

Embodiments disclosed herein relate generally to cutting structures for use on drilling tool assemblies. More specifically, embodiments disclosed herein relate to asymmetric cutting structures disposed on downhole reamer cutter blocks.

2. Background Art

FIG. 1A shows one example of a conventional drilling system for drilling an earth formation. The drilling system includes a drilling rig 10 used to turn a drilling tool assembly 12 that extends downward into a well bore 14. The drilling tool assembly 12 includes a drillstring 16, and a bottomhole assembly (BHA) 18, which is attached to the distal end of the drillstring 16. The "distal end" of the drillstring is the end furthest from the drilling rig. The drillstring 16 includes several joints of drill pipe 16*a* connected end to end through tool joints 16*b*. The drillstring 16 is used to transmit drilling fluid (through a central bore) and to transmit rotational power from the drilling rig 10 to the BHA 18. In some cases the drillstring 16 further includes additional components such as subs, pup joints, etc.

The BHA 18 includes at least a drill bit 20. Typical BHA's may also include additional components attached between the drillstring 16 and the drill bit 20. Examples of additional BHA components include drill collars, stabilizers, measurement-while-drilling (MWD) tools, logging-while-drilling (LWD) tools, subs, hole enlargement devices (e.g., hole openers and reamers), jars, accelerators, thrusters, downhole motors, and rotary steerable systems. In certain BHA designs, the BHA may include a drill bit 20 or at least one secondary cutting structure or both. In general, drilling tool assemblies 12 may include other drilling components and accessories, such as special valves, kelly cocks, blowout preventers, and safety valves. Additional components included in a drilling tool assembly 12 may be considered a part of the drillstring 16 or a part of the BHA 18 depending on their locations in the drilling tool assembly 12. The drill bit 20 in the BHA 18 may be any type of drill bit suitable for drilling earth formation. Two common types of drill bits used for drilling earth formations are fixed-cutter (or fixed-head) bits and roller cone bits.

In the drilling of oil and gas wells, concentric casing strings are installed and cemented in the borehole as drilling progresses to increasing depths. Each new casing string is supported within the previously installed casing string, thereby limiting the annular area available for the cementing operation. Further, as successively smaller diameter casing strings are suspended, the flow area for the production of oil and gas is reduced. Therefore, to increase the annular space for the cementing operation, and to increase the production flow area, it is often desirable to enlarge the borehole below the terminal end of the previously cased borehole. By enlarging the borehole, a larger annular area is provided for subsequently installing and cementing a larger casing string than would have been possible otherwise. Accordingly, by enlarging the borehole below the previously cased borehole, the bottom of the formation may be reached with comparatively larger diameter casing, thereby providing more flow area for the production of oil and gas.

Various methods have been devised for passing a drilling assembly through an existing cased borehole and enlarging the borehole below the casing. One such method is the use of an underreamer, which has basically two operative states—a closed or collapsed state, where the diameter of the tool is sufficiently small to allow the tool to pass through the existing cased borehole, and an open or partly expanded state, where one or more expandable arms with cutting elements on the ends thereof extend from the tool body. In the expanded position, the underreamer enlarges the borehole diameter as the tool is rotated and lowered in the borehole.

Underreamers with expandable cutter blocks having cutting elements thereon allow a drilling operator to run the underreamer to a desired depth within a borehole, actuate the underreamer from a collapsed position to an expanded position, and enlarge a borehole to a desired diameter. Cutting elements of expandable underreamers may allow for underreaming, stabilizing, or backreaming, depending on the position and orientation of the cutting elements on the blades. Such underreaming may thereby enlarge a borehole by 15-40%, or greater, depending on the application and the specific underreamer design.

Typically, expandable underreamer design includes placing two blades in groups, referred to as a block, around a tubular body of the tool. A first blade, referred to as a leading blade absorbs a majority of the load, the leading load, as the tool contacts the formation. A second blade, referred to as a trailing blade, and positioned rotationally behind the leading blade on the tubular body then absorbs a trailing load, which is less than the leading load. Thus, the cutting elements of the leading blade traditionally bear a majority of the load, while cutting elements of the trailing blade only absorb a majority of the load after failure of the cutting elements of the leading blade. Such design principles, resulting in unbalanced load conditions on adjacent blades, often result in premature failure of cutting elements, blades, and subsequently, the underreamer.

Conventional expandable reamers may be characterized as "near symmetrical," in that the layout of cutting elements on the multiple cutter blocks is similar and the cutter blocks are equally spaced around a circumference of the underreamer. For example, conventional underreamers may have three cutter blocks spaced 120 degrees apart from each other. Further, each cutter block may have multiple rows of cutting elements thereon, each row having an equal number of cutting elements. Thus, the conventional cutting structure layouts are inherently symmetrical or near symmetrical. While near-symmetrical reamers may be sufficiently stable in a static state (i.e., not moving), variable factors such as changing formation properties, deviated well profiles (e.g., vertical and/or horizontal wells), and variable drilling parameters (e.g., drillstring revolutions per minute, weight on bit, etc.) may cause instability in the reamer when in a dynamic state (i.e., while drilling). In particular, vibrations may be created in the reamer due to the variable factors above. The vibrations may be periodic in nature because of the near symmetrical arrangement of the cutting elements and cutter blocks on the reamer. The vibrations may continue to amplify with each rotation of the reamer unless the pattern is interrupted in some manner.

Accordingly, there exists a need for apparatuses and methods of designing cutting structures for reamers that are capable of interrupting and reducing vibrations created during drilling.

SUMMARY OF THE DISCLOSURE

In one aspect, embodiments disclosed herein relate to a cutting structure for use with a reamer in enlarging a borehole in a subterranean formation, the cutting structure including a plurality of cutter blocks, radially extendable from a reamer body away from a central axis of the reamer body, each of the plurality of cutter blocks comprising at least one cutter blade thereon, wherein an angular spacing about the central axis of the reamer body between the at least one cutter blade on each of the plurality of cutter blocks is unequal.

In other aspects, embodiments disclosed herein relate to a cutting structure for use with a reamer in enlarging a borehole in a subterranean formation, the cutting structure including at least one set of diametrically opposed cutter blocks, radially extendable from a reamer body away from a central axis of the reamer body, each of the cutter blocks comprising at least one cutter blade thereon and a plurality of cutting elements disposed on the at least one cutter blade.

Other aspects and advantages of the invention will be apparent from the following description and the appended claims.

DETAILED DESCRIPTION

In one aspect, embodiments disclosed herein relate to asymmetrical cutting structures for drilling tool assemblies. Particularly, embodiments disclosed herein relate to various configurations of multiple components of cutting structures used with underreamers, including but not limited to, cutter blades and cutting elements thereon, which may provide an asymmetrical nature to the cutting structures.

Figure 1A:
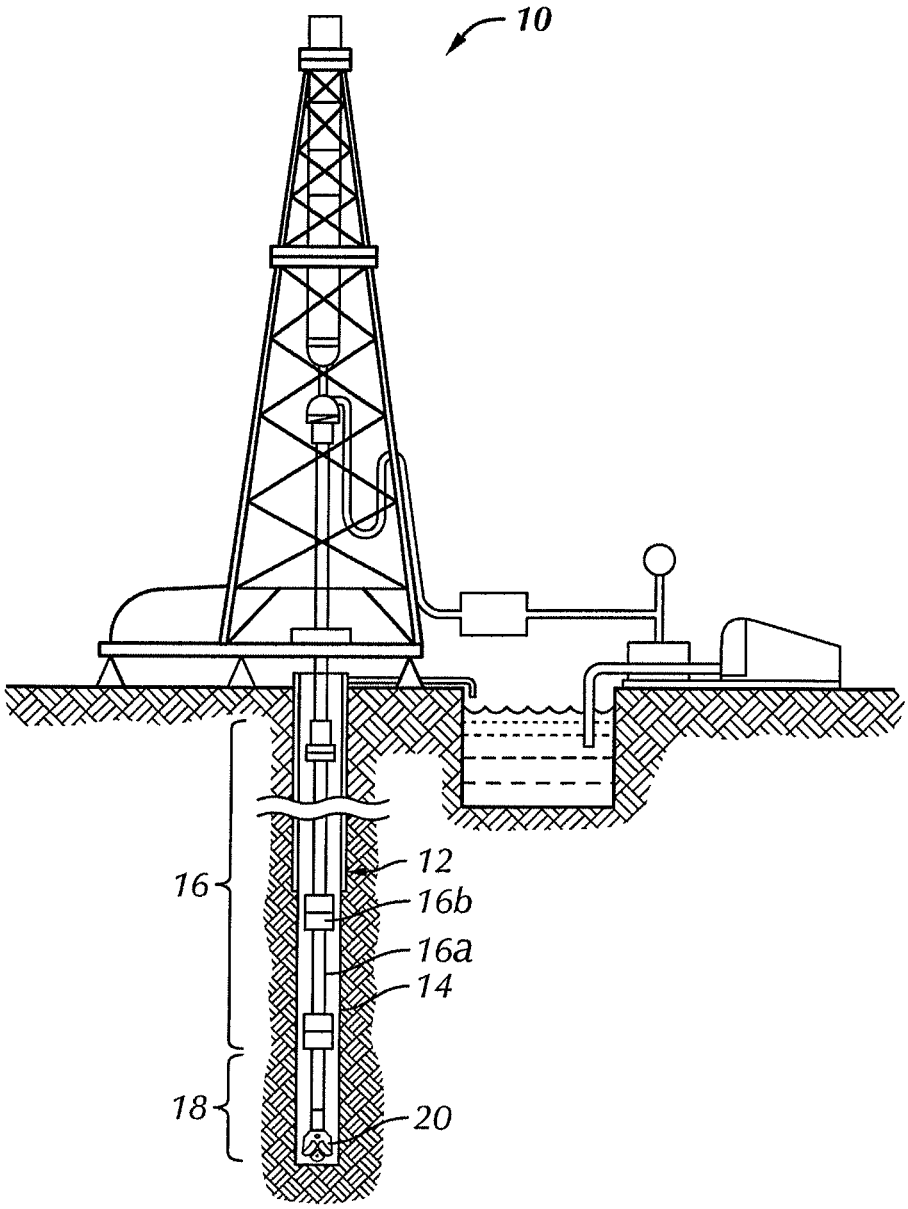
FIG. 1A (Prior Art)
FIG. 1A is a schematic representation of a drilling operation.
Figure 1B:
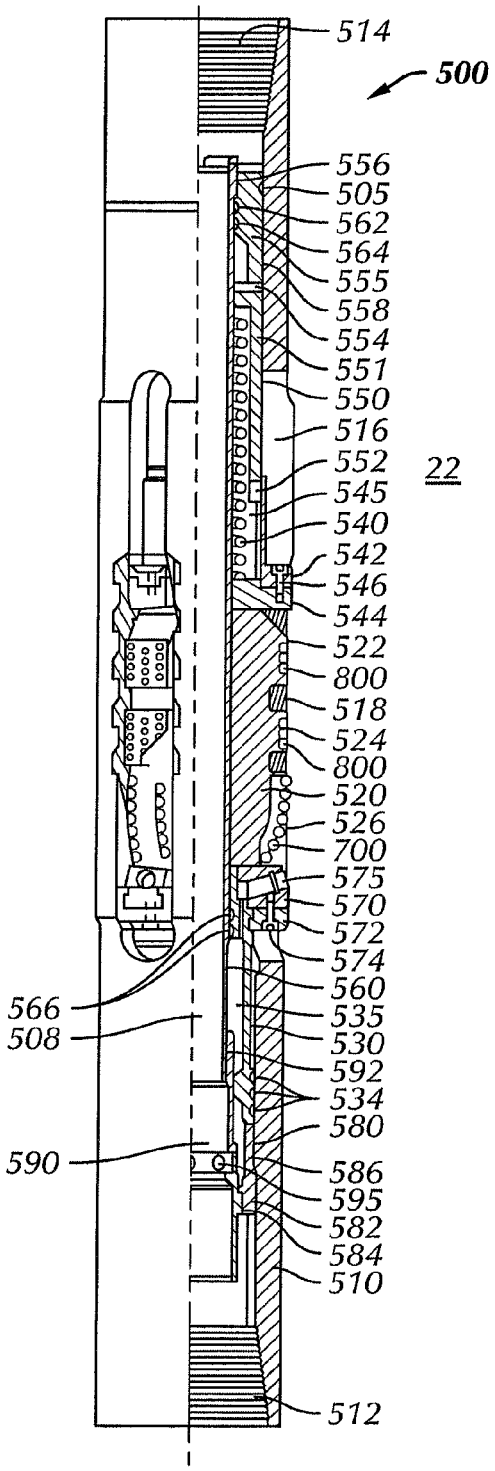
FIGS. 1B and 1C are partial cut away views of an expandable cutting structure.
Figure 1C:
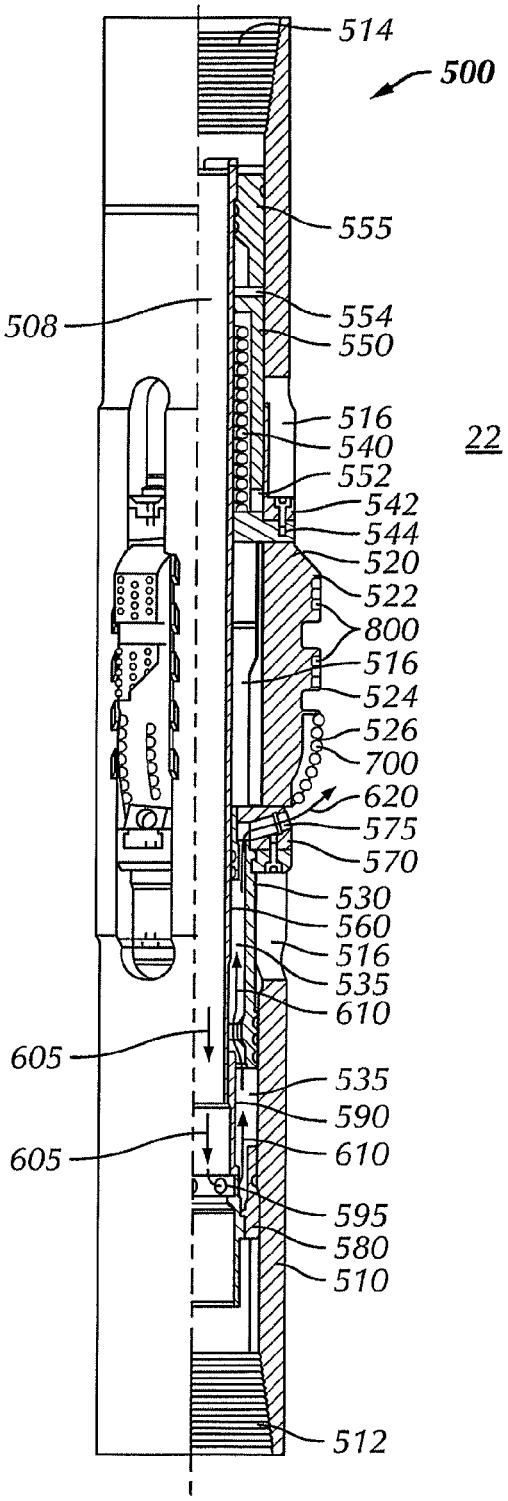

Referring now to FIGS. 1B and 1C, an expandable tool, which may be used in embodiments of the present disclosure, generally designated as 500, is shown in a collapsed position in FIG. 1B and in an expanded position in FIG. 1C. The expandable tool 500 comprises a generally cylindrical tubular tool body 510 with a flowbore 508 extending therethrough. The tool body 510 includes upper 514 and lower 512 connection portions for connecting the tool 500 into a drilling assembly. In approximately the axial center of the tool body 510, one or more pocket recesses 516 are formed in the body 510 and spaced apart azimuthally around the circumference of the body 510. The one or more recesses 516 accommodate the axial movement of several components of the tool 500 that move up or down within the pocket recesses 516, including one or more moveable, non-pivotable tool arms 520. Each recess 516 stores one moveable arm 520 in the collapsed position.

FIG. 1C depicts the tool 500 with the moveable arms 520 in the maximum expanded position, extending radially outwardly from the body 510. Once the tool 500 is in the borehole, it is only expandable to one position. Therefore, the tool 500 has two operational positions—namely a collapsed position as shown in FIG. 1B and an expanded position as shown in FIG. 1C. However, a spring retainer 550, which is a threaded sleeve, may be adjusted at the surface to limit the full diameter expansion of arms 520. Spring retainer 550 compresses a biasing spring 540 when the tool 500 is collapsed, and the position of the spring retainer 550 determines the amount of expansion of the arms 520. Spring retainer 550 is adjusted by a wrench in a wrench slot 554 that rotates the spring retainer 550 axially downwardly or upwardly with respect to the body 510 at threads 551.

In the expanded position shown in FIG. 1C, the arms 520 will either underream the borehole or stabilize the drilling assembly, depending on the configuration of pads 522, 524 and 526. In FIG. 1C, cutting structures 700 on pads 526 are configured to underream the borehole. Depth of cut limiters (i.e., depth control elements) 800 on pads 522 and 524 provide gauge protection as the underreaming progresses. Hydraulic force causes the arms 520 to expand outwardly to the position shown in FIG. 1C due to the differential pressure of the drilling fluid between the flowbore 508 and the annulus 22.

The drilling fluid flows along path 605, through ports 595 in lower retainer 590, along path 610 into the piston chamber 535. The differential pressure between the fluid in the flowbore 508 and the fluid in the borehole annulus 22 surrounding tool 500 causes the piston 530 to move axially upwardly from the position shown in FIG. 1B to the position shown in FIG.

1C. A small amount of flow can move through the piston chamber 535 and through nozzles 575 to the annulus 22 as the tool 500 starts to expand. As the piston 530 moves axially upwardly in pocket recesses 516, the piston 530 engages the drive ring 570, thereby causing the drive ring 570 to move axially upwardly against the moveable arms 520. The arms 520 will move axially upwardly in pocket recesses 516 and also radially outwardly as the arms 520 travel in channels 518 disposed in the body 510. In the expanded position, the flow continues along paths 605, 610 and out into the annulus 22 through nozzles 575. Because the nozzles 575 are part of the drive ring 570, they move axially with the arms 520. Accordingly, these nozzles 575 are optimally positioned to continuously provide cleaning and cooling to the cutting structures 700 disposed on surface 526 as fluid exits to the annulus 22 along flow path 620.

The underreamer tool 500 may be designed to remain concentrically disposed within the borehole. In particular, tool 500, in one embodiment, preferably includes three extendable arms 520 spaced apart circumferentially at the same axial location on the tool 510. In one embodiment, the circumferential spacing may be approximately 120 degrees apart. This three-arm design provides a full gauge underreaming tool 500 that remains centralized in the borehole. While a three-arm design is illustrated, those of ordinary skill in the art will appreciate that in other embodiments, tool 510 may include different configurations of circumferentially spaced arms, for example, less than three-arms, four-arms, five-arms, or more than five-arm designs. Thus, in specific embodiments, the circumferential spacing of the arms may vary from the 120-degree spacing illustrated herein. For example, in alternate embodiments, the circumferential spacing may be 90 degrees, 60 degrees, or be spaced in non-equal increments.

In accordance with embodiments of the present disclosure, at least one diamond enhanced element may be provided on at least one cutter blade of a cutting structure. As used herein, the term diamond enhanced element refers to an element having a non-planar diamond working surface. Cutting elements may be cylindrically bodied cemented tungsten carbide elements with a layer of polycrystalline diamond (PCD) optionally forming the cutting surface thereof. When used with a PCD layer, cutting elements may be similar to polycrystalline diamond compact (PDC) cutters. Such PDC cutters have a planar working or upper surface.

The diamond enhanced elements 128 (variations of which are shown in FIGS. 10A-10D) possess a diamond layer 132 on a substrate 134 (such as a cemented tungsten carbide substrate), where the diamond layer 132 forms a non-planar diamond working surface (specifically, a conical working surface as shown in FIG. 2). Diamond enhanced elements 128 may be formed in a process similar to that used in forming diamond enhanced inserts or may include formation of the non-planar end of the element (that includes a diamond layer 132 on a substrate 134), which is then joined to a base 136 such as by brazing or other attachment mechanisms known in the art. The interface (not shown separately) between diamond layer 132 and substrate 134 may be non-planar or non-uniform, for example, to aid in reducing incidents of de-lamination of the diamond layer 132 from substrate 134 when in operation and to improve the strength and impact resistance of the element. One skilled in the art would appreciate that the interface may include one or more convex or concave portions, as know in the art of non-planar interfaces. Additionally, one skilled in the art would appreciate that use of some non-planar interfaces may allow for greater thickness in the diamond layer in the tip region of the layer. Further, it may be desirable to create the interface geometry such that the diamond layer is thickest at a critical zone that encompasses the primary contact zone between the diamond enhanced element and the casing. Additional shapes and interfaces that may be used for the diamond enhanced elements of the present disclosure include those described in U.S. Patent Publication No. 2008/0035380, which is herein incorporated by reference in its entirety. In certain embodiments disclosed herein, the element 128 may be non-diamond based, and thus, may have a tungsten carbide conical working surface. In other embodiments, any of diamond enhanced elements may be replaced with a cemented tungsten carbide conical-shaped element.

Figure 2A:
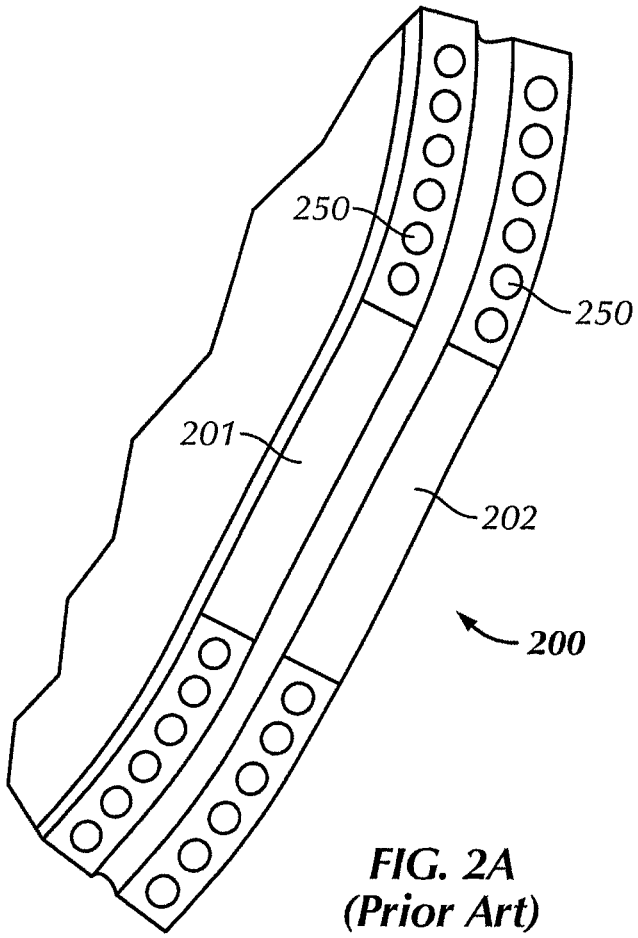
FIG. 2A (Prior Art)
FIG. 2A is a perspective view of an expandable cutter block of conventional reamers.

Referring to FIG. 2A, a perspective view of a cutter block 200 used with conventional underreamers is shown. Cutter block 200 includes a leading blade 201 and a trailing blade 202, and each cutter blade 201, 202 includes a plurality of cutting elements 250 disposed thereon. Cutting elements 250 are disposed on cutter blades 201, 202 in specific locations and with a specific orientation to achieve a desired cutting pattern. The position of the individual cutting elements 250 on cutter blades 201, 202 defines a cutting arrangement. As shown, cutting elements 250 are arranged along cutter blades 201, 202 in alignment with a longitudinal axis of the cutter blades 201, 202, and which may be characterized as a "straight" arrangement. While only a straight arrangement is shown, in alternate embodiments, cutting elements 250 may be arranged along cutter blades 201, 202 in other arrangements, including helical, semi-circle, diagonal and other cutting element arrangements known to those skilled in the art.

Figure 2B:
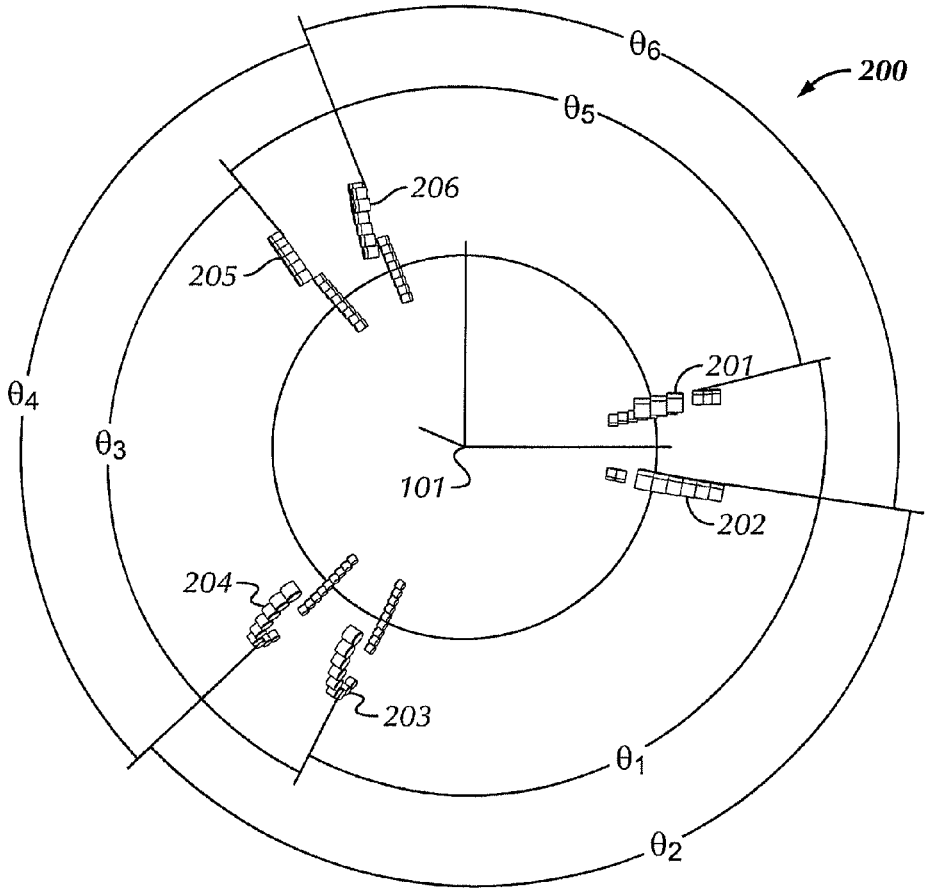
FIG. 2B (Prior Art)
FIG. 2B is a layout view of a near-symmetrical cutting structure of conventional reamers.

Referring to FIG. 2B, a layout view of a cutting structure 200 used with conventional underreamers is shown. As previously described, each of the multiple cutter blocks (not shown) has one or more cutter blades disposed thereon. A first cutter block has cutter blades 201, 202 disposed thereon, a second cutter block has blades 203, 204 disposed thereon, and a third cutter block has blades 205, 206 disposed thereon as shown. A near-symmetrical cutting structure may be characterized as having the cutter blocks and the cutter blades thereon equally spaced about a central axis 101. As such, angular spacing between each of the leading cutter blades 201, 203, 205 is substantially equal (i.e., $\Theta_1 \approx \Theta_3 \approx \Theta_5$) and angular spacing between each of the trailing cutter blades 202, 204, 206 is substantially equal (i.e., $\Theta_2 \approx \Theta_4 \approx \Theta_6$).

In certain embodiments, asymmetry may be created among the cutter blocks shown in FIG. 2B using a combination of different cutting element 250 arrangements. In certain embodiments, a number of cutting elements 250 on each of the cutter blades 201, 202 may be varied, i.e., a number of cutting elements 250 on the leading cutter blade 201 may be different from a number of cutting elements 250 disposed on the trailing cutter blade 202. In other embodiments, heights of the cutting element 250 (i.e., cut depth) may be varied along each cutter blade 201, 202. For example, various cutting elements 250 may be set at different heights or cut depths such that an uneven profile of cutting elements 250 may be created along the cutter blades 201, 202.

Figure 2C:
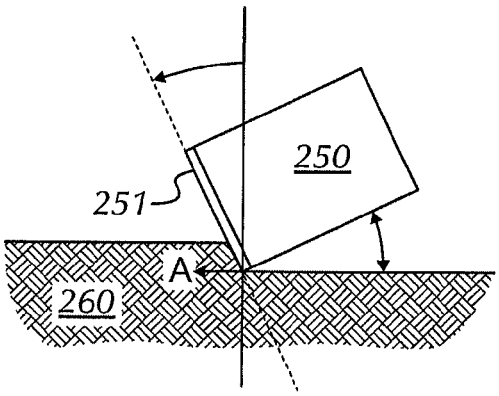
FIGS. 2C and 2D are schematic views of side rake and back rake angles of cutting elements in accordance with embodiments of the present disclosure.
Figure 2D:
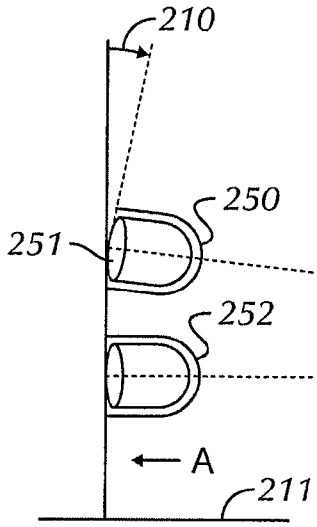

In still further embodiments, various side rake/back rake combinations may be incorporated among different cutting elements 250 along cutter blades 201, 202. Referring to FIG. 2C, a schematic illustration of a back rake of a cutting element contacting formation in accordance with embodiments of the present disclosure is shown. In this embodiment, cutting element 250 is shown contacting formation 260, as the cutting element 250 moves in direction A. One design element that may be modified in a cutting element arrangement, according to embodiments disclosed herein, includes the back rake angle of individual cutting elements 250. Back rake angle defines the aggressiveness of the cutter, and is defined as the angle between the normal direction of cutting element movement and a cutting element face plane 251. Accordingly, a cutting element 250 having 0° of back rake would be perpendicular to the formation being drilled. Referring now to FIG. 2D, a schematic illustration of a side rake of a cutting element contacting formation in accordance with embodiments of the present disclosure is shown. A side rake angle 210 is the angle between the cutting element face 251 and the radial plane of the secondary cutting structure centerline 211. As such, cutting element 250 is illustrated having 0° of side rake, while cutting element 252 is illustrated having greater than 5° of side rake. Any combination of side rake/back rake configurations may be used to create asymmetry among cutter blades in accordance with embodiments disclosed herein.

Figure 3A:
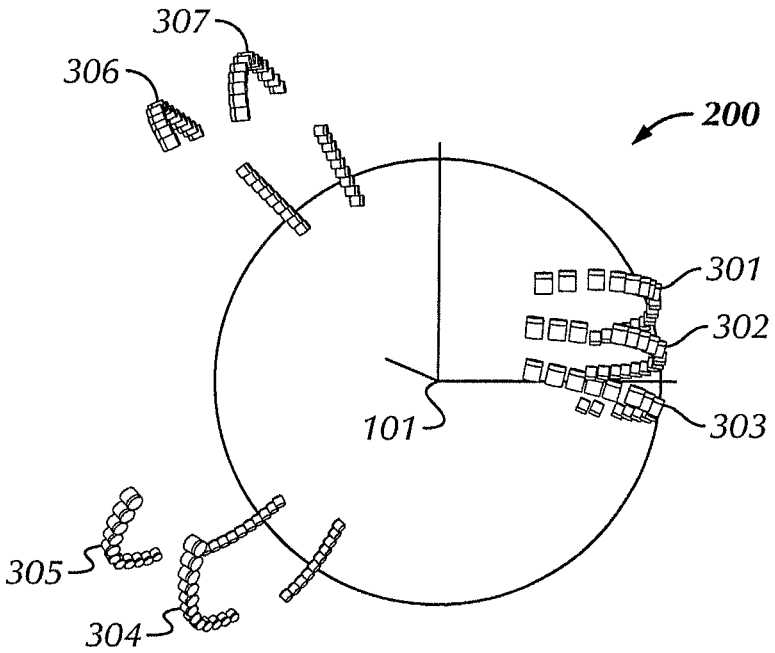
FIGS. 3A and 3B are layout views of asymmetrical cutting structures having different numbers of cutter blades per cutter block in accordance with embodiments of the present disclosure.
Figure 3B:
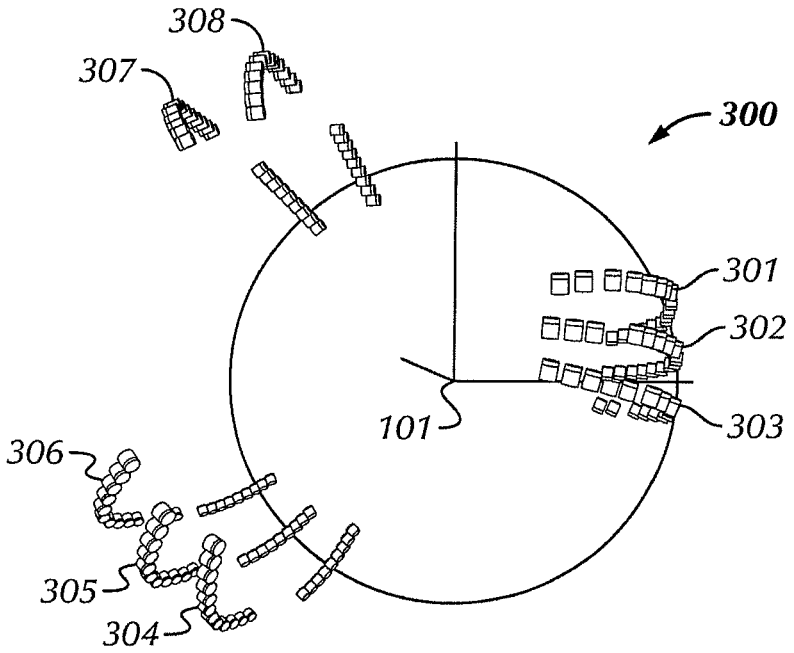

Now referring to FIGS. 3A and 3B, layout views of asymmetrical cutting structures 300 in accordance with embodiments of the present disclosure are shown. FIGS. 3A and 3B illustrate cutting structures 300 having cutter blade arrangements on cutter blocks (not shown) in which there are an asymmetric number of cutter blades per cutter block (i.e., different numbers of cutter blades per cutter block). For example, as shown in FIG. 3A, three cutter blades 301, 302, 303 are disposed on a first cutter block (not shown), while two cutter blades 304, 305 are disposed on a second cutter block, and two cutter blades 306, 307 are disposed on a third cutter block. As shown in FIG. 3B, three cutter blades 301, 302, 303 are disposed on a first cutter block, three cutter blades 304, 305, 306 are disposed on a second cutter block, and two cutter blades 307, 308 are disposed on a third cutter block. One skilled in the art will appreciate a number of alternative asymmetrical cutter blade arrangements incorporating different numbers of cutter blades per cutter block that may be used in accordance with embodiments disclosed herein.

Figure 4A:
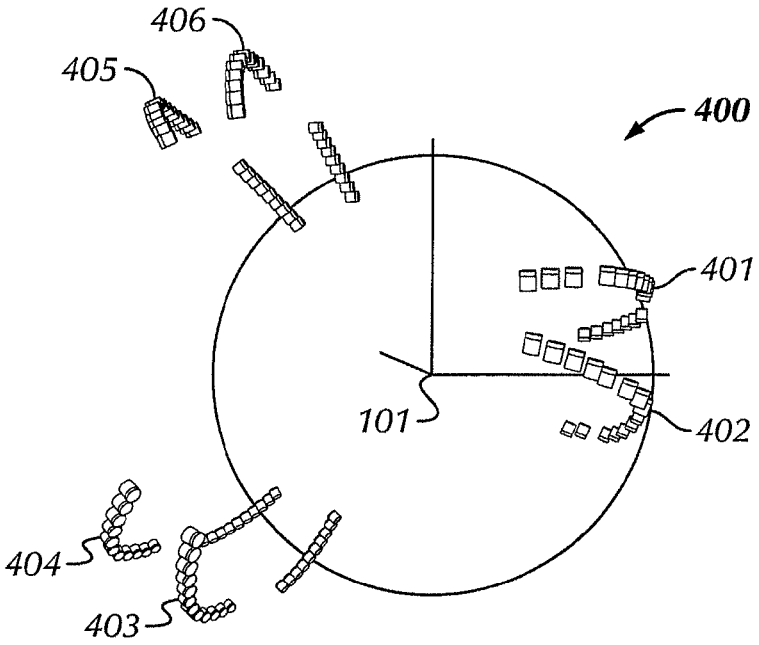
FIGS. 4A and 4B are layout views of asymmetrical cutting structures in which cutter blades have a helical arrangement of cutting elements thereon in accordance with embodiments of the present disclosure.
Figure 4B:
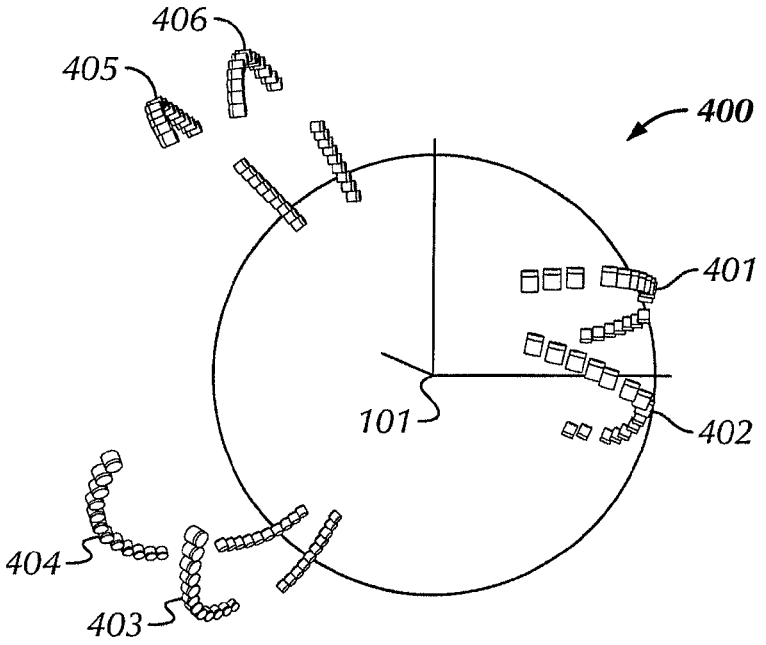

Referring now to FIGS. 4A and 4B, layout views of asymmetrical cutting structures 400 in accordance with embodiments of the present disclosure are shown. FIGS. 4A and 4B illustrate cutting structures 400 in which select cutter blades are configured having a helical cutting element arrangement along a cutter blade length. As used herein, a helical cutting element arrangement may be defined as aligning the cutting elements in a spiraling fashion along a longitudinal length of a cutter blade. For example, as shown in FIG. 4A, cutter blade 402 is configured having a helical cutting element arrangement along its length, while cutter blade 401 is configured having a straight cutting element arrangement along its length, i.e., in line with a longitudinal axis of the cutter block. Cutter blades 403, 404 on the second cutter block and cutter blades 405, 406 on the third cutter block are also configured having straight cutting element arrangements. Alternatively, as shown in FIG. 4B, cutter blade 402 is configured having a helical cutting element arrangement while blade 401 is configured having a straight cutting element arrangement, cutter blade 403 is configured having a helical cutting element arrangement while blade 404 is configured having a straight cutting element arrangement, and cutter blades 405, 406 are configured having a straight cutting element arrangement.

One skilled in the art will appreciate further alternative asymmetrical cutter blade arrangements incorporating helical cutting element arrangements in one or more cutter blades on one or more cutter blocks that may be used in accordance with embodiments disclosed herein. In addition, one skilled in the art will appreciate further cutting element configurations that may be incorporated, including diagonal and semicircle arrangements. Any different combination of cutting element arrangements may be used on the multiple cutter blades in accordance with embodiments disclosed herein.

Figure 5:
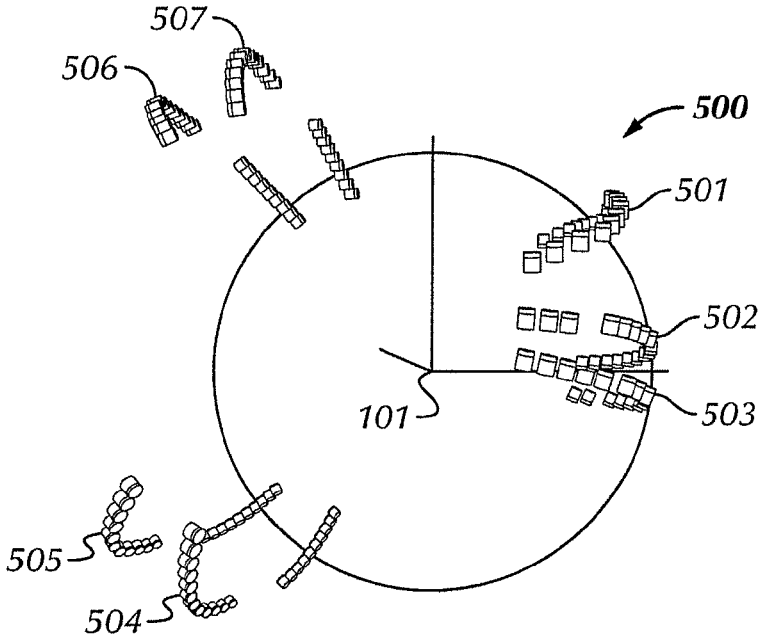
FIG. 5 is a layout view of an asymmetrical cutting structure having different numbers of cutter blades per cutter block and cutter blades have a helical arrangement of cutting elements thereon in accordance with embodiments of the present disclosure.

FIG. 5 shows a layout view of an asymmetrical cutting structure that incorporates a combination of the two asymmetrical arrangements discussed in the previous paragraphs with FIGS. 3A-4B. As shown, three cutter blades 501, 502, 503 are disposed on a first cutter block, while two cutter blades 504, 505 and 506, 507 are disposed on second and third cutter blocks, respectively. Further, at least one cutter blade 501 on the first cutter block is configured having a helical cutting element arrangement, while the remaining two cutter blades 502, 503 are configured having straight cutting element arrangements. Thus, the asymmetrical arrangement shown in FIG. 5 incorporates both a variable number of cutter blades per cutter block and cutter blade helical cutting element arrangements. One skilled in the art will appreciate further alternative asymmetrical cutter blade arrangements that incorporate both variable numbers of cutter blades per cutter block and cutter blade helical cutting element arrangements that may be used in accordance with embodiments disclosed herein.

Figure 6:
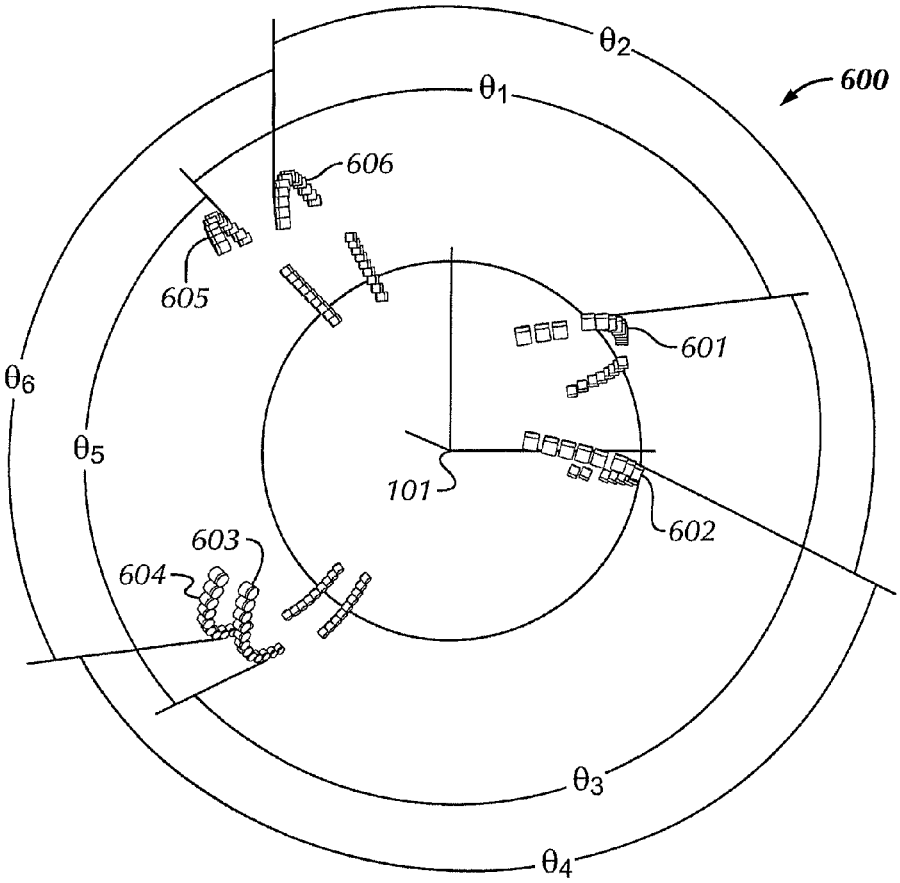
FIG. 6 is a layout view of an asymmetrical cutting structure having unequal angular spacing about a central axis between corresponding cutter blades in accordance with embodiments of the present disclosure.

Referring now to FIG. 6, a layout view of an asymmetrical cutting structure 600 in accordance with embodiments disclosed herein is shown. FIG. 6 illustrates a cutting structure 600 having asymmetric angles between cutter blades around a central axis 101 of the cutting structure 600. As shown, the cutting structure 600 includes leading cutter blades 601, 603, 605, and trailing cutter blades 602, 604, 606. Unlike the cutting structure illustrated in FIG. 2B, the angular spacing between corresponding leading and trailing cutter blades about a central axis 101 may vary about the central axis 101. As such, angular spacing between each of the leading cutter blades 601, 603, 605 is unequal (i.e., $\Theta_1 \neq \Theta_3 \neq \Theta_5$) and angular spacing between each of the trailing cutter blades 602, 604, 606 is unequal (i.e., $\Theta_2 \neq \Theta_4 \neq \Theta_6$). In alternate embodiments, angular spacing between corresponding leading cutter blades may be partially unequal (i.e., $\Theta_1 = \Theta_3 \neq \Theta_5$ or $\Theta_1 \neq \Theta_3 = \Theta_5$) and angular spacing between corresponding trailing cutter blades may be partially unequal (i.e., $\Theta_2 = \Theta_4 \neq \Theta_6$ or $\Theta_2 \neq \Theta_4 = \Theta_6$)

Figure 8:
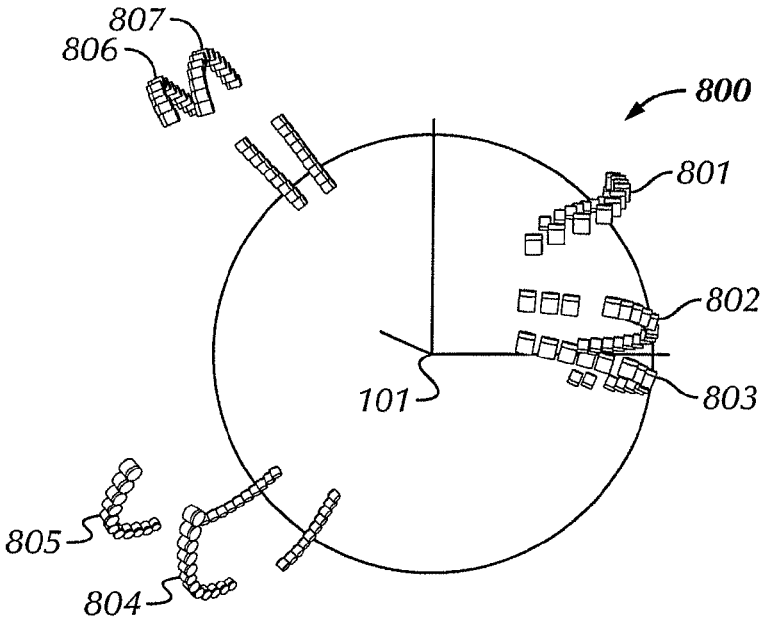
FIG. 8 is a layout view of an asymmetrical cutting structure having unequal angular spacing about a central axis between corresponding cutter blades, different numbers of cutter blades per cutter block, and a helical arrangement of cutting elements in accordance with embodiments of the present disclosure.
Figure 7:
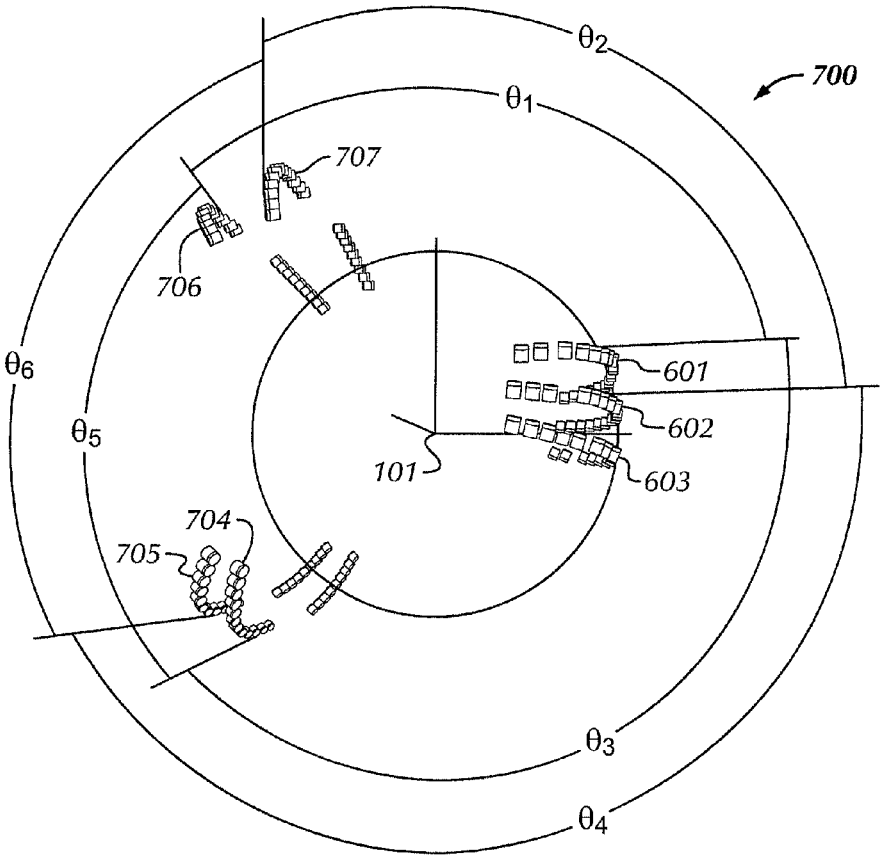
FIG. 7 is a layout view of an asymmetrical cutting structure having unequal angular spacing about a central axis between corresponding cutter blades and different numbers of cutter blades per cutter block in accordance with embodiments of the present disclosure.
Figure 10A:
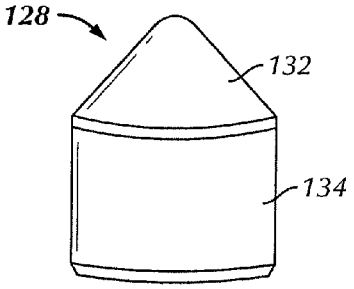
FIGS. 10A-10D are profile views of cutting elements in accordance with embodiments of the present disclosure.
Figure 10B:
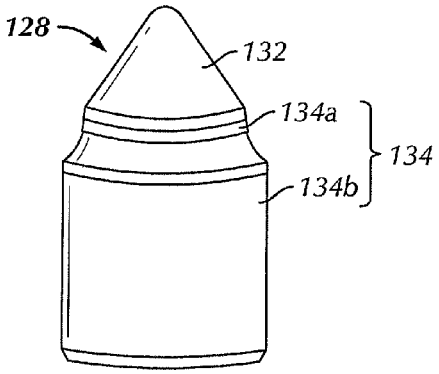
Figure 10C:
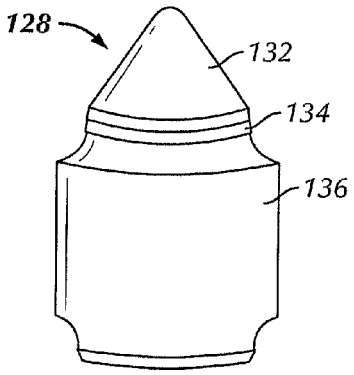
Figure 10D:
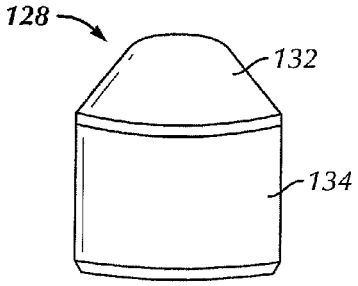

Now referring to FIGS. 7 and 8, layout views of asymmetrical cutting structures 700, 800 having a combination of asymmetrical configurations described above in accordance with embodiments of the present disclosure are shown. FIG. 7 illustrates a cutting structure 700 having asymmetric angles between corresponding cutter blades (as described with FIG. 6) and different numbers of cutter blades per cutter block (as described with FIGS. 3A and 3B). As shown, a first cutter block includes three cutter blades 701, 702, 703, while the second cutter block includes two cutter blades 704, 705, and the third cutter block includes two cutter blades 706, 707. In addition, the angular spacing between corresponding leading and trailing cutter blades about a central axis 101 is different. As such, angular spacing between each of the leading cutter blades 701, 703, 705 is unequal (i.e., $\Theta_1 \neq \Theta_3 \neq \Theta_5$) and angular spacing between each of the trailing cutter blades 702, 704, 706 is unequal (i.e., $\Theta_2 \neq \Theta_4 \neq \Theta_6$).

FIG. 8 illustrates a cutting structure 800 having asymmetric angles between corresponding cutter blades, different numbers of cutter blades per cutter block, and cutting elements arranged in a helical fashion. As shown, a first cutter block includes three cutter blades 801, 802, 803, a second cutter block includes two cutter blades 804, 805, and a third cutter block includes two cutter blades 806, 807. In addition, the angular spacing between corresponding leading and trailing cutter blades about a central axis 101 is different. Finally, cutter blade 801 is arranged in a helical configuration along the first cutter block, while the remaining two cutter blades 802, 803 are arranged in a straight configuration.

Any combination of the cutting element and cutter blade arrangements described above may be used in combination to create asymmetrical cutting structures in accordance with embodiments disclosed herein. Combinations of features to create asymmetrical cutting structures may include, but are not limited to, variations of the number of cutting elements per cutter blade, height variations of cutting elements along cutter blades, and variations of cutting element side rake/back rake angles along cutter blades. Further combinations of features may include, but are not limited to, variations of the number of cutter blades per cutter block, variations in a cutting element arrangement on the cutter blocks (i.e., helical arrangements), and variations in angular spacing between corresponding leading/trailing cutter blades.

Figure 9:
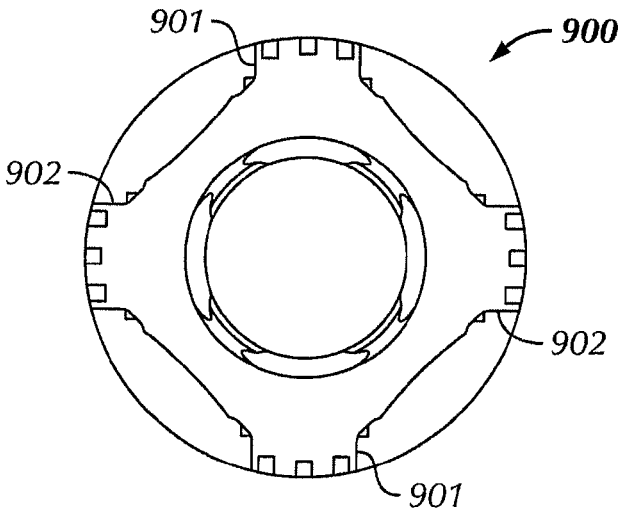
FIG. 9 is a cross-section view of a reamer structure having diametrically opposed cutter blocks in accordance with embodiments of the present disclosure.

Still further, certain embodiments disclosed herein may include a reamer structure having extendable cutter arms that are located diametrically opposite of each other as shown in FIG. 9. As shown, a reamer body 900 includes two sets of diametrically opposed cutter arms 901 and cutter arms 902 that extend radially therefrom. As used herein, a set includes two diametrically opposed (i.e., located 180 degrees apart) cutter arms. While four cutter arms 901, 902 are shown (i.e., two sets of diametrically opposed cutter arms 901, 902), any number of sets of diametrically opposed cutter arms may be used in accordance with embodiments disclosed herein (e.g., one set of two diametrically opposed cutter arms, three sets, four sets, etc.).

Advantageously, embodiments of the present disclosure for asymmetrical cutting structures may provide a dynamically balanced cutting structure capable of reducing or eliminating vibrations created in the cutting structure and remaining tools in the drillstring. Further, embodiments disclosed herein allow for the best utilization of total energy towards drilling, i.e., a more stable cutting structure, which allows a majority of the energy to be transferred towards actual drilling. The improved utilization of cutting energy allows for faster rate of penetration through the formation and more efficient drilling. In addition, embodiments disclosed herein reduce the forces or loads acting on individual cutting elements, thus making the cutting structure more durable and increasing the useful life of the cutting structure. In addition, because of the reduction of loads on the cutting elements and less vibrations, chances of cutting element failure due to impact against the formation may be reduced.

Further, the diametrically opposed cutter blocks may be advantageous by increasing sectional stiffness of the reamer body downhole. In addition, the diametrically opposed cutter blocks may allow more cutting elements to be disposed on the cutter blocks, which may reduce dynamic forces on each cutting element as it is shared by a larger number of cutting elements and improve the cutting structure durability. Finally, the diametrically opposed cutter blocks may create additional junk slots which will improve cutting element cleaning efficiency by increasing fluid velocity, thereby keeping the cutting elements sharper and improving the rate of penetration through the formation.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

The invention claimed is:

1. A cutting structure for use with an expandable reamer in enlarging a borehole in a subterranean formation, the cutting structure comprising:

a plurality of cutter blocks radially extendable from a reamer body away from a central axis of the expandable reamer, each of the plurality of cutter blocks comprising at least one cutter blade thereon;

a first cutter blade on each of the plurality of cutter blocks each defining a leading cutter blade with respect to a direction of rotation; and a plurality of cutting elements disposed on the at least one cutter blade, wherein the plurality of cutting elements include cylindrically bodied cutting elements having a working surface geometry of at least one selected from a dome-shaped working surface and a conical working surface, and wherein the plurality of cutter blocks and plurality of cutting elements define a cutting structure that is asymmetric.

2. The cutting structure of claim 1, wherein each of the plurality of cutting elements are diamond enhanced elements.

3. The cutting structure of claim 2, wherein the working surface is formed from a layer of polycrystalline diamond.

4. The cutting structure of claim 3, wherein each of the plurality of cutting elements comprise a substrate and a diamond layer disposed on the substrate.

5. The cutting structure of claim 1, further comprising at least one trailing cutter blade disposed behind the leading cutter blade with respect to the direction of rotation.

6. The cutting structure of claim 5, wherein a working surface geometry of the at least one trailing cutter blade is different from a working surface geometry of the leading cutter blade.

7. The cutting structure of claim 1, wherein the plurality of cutting elements disposed on the at least one cutter blade include cutting elements having a dome-shaped working surface and cutting elements having a conical working surface.

8. The cutting structure of claim 7, wherein a height of cutting elements having the conical working surface is greater than a height of cutting elements having the dome-shaped working surface.

9. The cutting structure of claim 7, wherein a height of cutting elements having the dome-shaped working surface is greater than a height of cutting elements having the conical working surface.

10. The cutting structure of claim 7, wherein a height of the cutting elements having the dome-shaped working surface and cutting elements having the conical working surface are about equal.

11. The cutting structure of claim 7, wherein cutting elements having the conical working surface and cutting elements having the dome-shaped working surface are disposed on the at least one cutter blade in an alternating pattern.

12. The cutting structure of claim 1, wherein the plurality of cylindrically bodied cutting elements are secured in the at least one cutter blade having a specified combination of a side rake angle and a back rake angle.

13. A cutting structure for use with an expandable reamer in enlarging a borehole in a subterranean formation, the cutting structure comprising:

an odd number of cutter blocks, each cutter block radially extendable from a reamer body away from a central axis of a reamer body and including multiple cutter blades thereon;

wherein spacing between the multiple cutter blades is varied; and a plurality of cutting elements disposed on each of the multiple cutter blades, wherein the plurality of cutting elements have a non-planar diamond working surface.

14. The cutting structure of claim 13, wherein the plurality of cutting elements are diamond enhanced elements.

15. The cutting structure of claim 13, wherein the non-planar diamond working surface is joined to a base.

16. The cutting structure of claim 15, wherein an interface between the non-planar diamond working surface and the base is a non-planar interface.

17. The cutting structure of claim 16, wherein an interface between the non-planar diamond working surface and the base is a convex interface.

18. The cutting structure of claim 16, wherein an interface between the non-planar diamond working surface and the base is a concave interface.

19. The cutting structure of claim 13, wherein the non-planar diamond working surface is thickest at a primary contact zone between the non-planar diamond working surface and the borehole.

20. The cutting structure of claim 13, wherein the plurality of cutting elements disposed on at least one cutter blade has a dome-shaped working surface.

21. The cutting structure of claim 13, wherein the plurality of cutting elements disposed on at least one cutter blade has a conical working surface.

22. The cutting structure of claim 13, wherein a first cutter blade on each of the odd number of cutter blocks each define a leading cutter blade with respect to a direction of rotation and at least a second cutter blade on each of the odd number of cutter blocks each define a trailing cutter blade with respect to a direction of rotation.

23. The cutting structure of claim 22, wherein a height of a plurality of cutting elements disposed on the leading cutter blade is different than a height of a plurality of cutting elements disposed on a trailing cutter blade.

24. The cutting structure of claim 22, wherein a height of a plurality of cutting elements disposed on the leading cutter blade and a height of a plurality of cutting elements disposed on a trailing cutter blade are about equal.

25. A cutting structure for use with an expandable reamer in enlarging a borehole in a subterranean formation, the cutting structure comprising:

a plurality of cutter blocks radially extendable from a reamer body away from a central axis of the reamer body, each of the plurality of cutter blocks including multiple cutter blades disposed thereon; and an angular spacing about the central axis of the reamer body between at least one cutter blade on each of the plurality of cutter blocks is unequal; and a plurality of cutting elements disposed on each of the multiple cutter blades, wherein the plurality of cutting elements include a cemented tungsten carbide element.

26. The cutting structure of claim 25, wherein the cemented tungsten carbide is a conical-shaped cutting element.

* * * * *